United States Patent [19]

Kitterman et al.

[11] Patent Number: 4,881,668

[45] Date of Patent: Nov. 21, 1989

[54] CLOSURE WITH OPEN LID RETAINER

[75] Inventors: Lawrence R. Kitterman, Antioch; Robert D. Rohr, Elgin, both of Ill.

[73] Assignee: Seaquist Closures, A division of Pittway Corporation, Crystal Lake, Ill.

[21] Appl. No.: 204,109

[22] Filed: Jun. 8, 1988

[51] Int. Cl.[4] ..... B65D 47/00

[52] U.S. Cl. ..... 222/482; 222/498; 222/545; 222/556; 222/565; 222/517

[58] Field of Search ..... 220/335, 337; 222/480, 222/482, 484, 485, 486, 545, 556, 565, 546, 517, 478, 498

[56] References Cited

U.S. PATENT DOCUMENTS

| | | | |
|---|---|---|---|
| 2,444,995 | 7/1948 | Laing | 222/498 |
| 2,832,517 | 4/1958 | Baumgartner . | |
| 2,950,833 | 8/1960 | Short . | |
| 3,140,019 | 7/1964 | Barr . | |
| 3,167,104 | 1/1965 | Wiley et al. . | |
| 3,262,606 | 7/1966 | Waterman | 222/480 |
| 3,322,299 | 5/1967 | Foster . | |
| 3,417,897 | 12/1968 | Johnson . | |
| 3,606,104 | 9/1971 | Rickmeier Jr. . | |
| 3,752,371 | 8/1973 | Susuki et al. | 222/517 X |
| 4,009,794 | 3/1977 | Zapp . | |
| 4,047,647 | 9/1977 | Lewis . | |
| 4,124,151 | 11/1978 | Hazard . | |
| 4,158,902 | 6/1979 | Chernack et al. . | |
| 4,261,486 | 4/1981 | Bush et al. . | |
| 4,291,818 | 9/1981 | Nozawa et al. . | |
| 4,369,879 | 1/1983 | Egly et al. . | |
| 4,369,901 | 1/1983 | Hidding . | |
| 4,449,628 | 5/1984 | Egly et al. . | |
| 4,545,508 | 10/1985 | Cribb Jr. et al. . | |
| 4,579,246 | 4/1986 | Swearingen et al. . | |
| 4,625,898 | 12/1986 | Hazard | 222/517 |
| 4,666,068 | 5/1987 | Bush | 222/546 |
| 4,693,399 | 9/1987 | Hickman et al. . | |
| 4,714,181 | 12/1987 | Kozlowski et al. . | |

*Primary Examiner*—Joseph J. Rolla
*Assistant Examiner*—Mona C. Beegle
*Attorney, Agent, or Firm*—Dressler, Goldsmith, Shore, Sutker & Milnamow, Ltd.

[57] ABSTRACT

A closure is provided for use on a container that has an opening communicating with the container interior. The closure includes a body for being mounted to the container over the container opening and for defining at least a first aperture communicating through the container opening with the container interior. The body includes a peripheral side wall outwardly of the first aperture. The closure includes a cover on the body for defining at least a first lid to cover the first aperture. The closure includes a first hinge for accommodating pivoting of the first lid between a closed position occluding first aperture and an open position spaced away from the first aperture and for connecting the first lid directly to another part of the cover or the body. The first lid includes a first engaging arm for engaging the body side wall when the first lid is in the open position. Either or both the first engaging arm and body side wall are resilient whereby the first lid is held in the open position by frictional engagement between the first engaging arm and the body side wall.

24 Claims, 2 Drawing Sheets

CLOSURE WITH OPEN LID RETAINER

TECHNICAL FIELD

This invention relates to closures for containers, and more particularly to a closure which incorporates means for holding the closure in an open orientation so that the container contents may be removed from the container.

BACKGROUND OF THE INVENTION AND TECHNICAL PROBLEMS POSED BY THE PRIOR ART

There are a variety of closures which have been developed and which have an attached lid or lids which can be opened to provide access to the container on which the closure is mounted. In some instances, the user may wish to have some means by which the lid can be held in the open position. In some conventional closures a snap-action hinge is provided to connect the lid to the closure body for holding the lid in the open position.

Although snap-action hinges, as well as other structures for holding a lid open, may generally function well, it would be desirable in some applications to provide an improved mechanism by which the lid may be held open.

It would be especially advantageous to provide an improved means by which the lid could be held open in an orientation approximately 120° from the closed orientation to allow access to the container contents.

It would also be desirable to provide a structure for holding a lid in an open orientation wherein the structure would maximize the amount of open space on the top surface of the closure as well as maximize the area on the closure available for dispensing the container contents.

Finally, in some applications, it would be desirable if such an improved structure for holding a lid open could be fabricated in a closure having a separate cover or lid structure that could be releasably mounted on the closure body. This would permit the cover or lid structure to be molded from thermoplastic material separately from the closure body. Such a closure could accommodate a variety of different designs and colors in the separate components. It would also permit such separate components to be more easily manufactured.

SUMMARY OF THE INVENTION

A closure is provided for use on a container defining an opening communicating with the container interior. The closure includes a body means for being mounted to the container over the container opening and for defining at least a first aperture for communicating through the container opening with the container interior. The body means has a peripheral side wall outwardly of the first aperture.

The closure includes a cover means on the body means for defining at least a first lid to cover the first aperture.

The closure includes at least a first hinge means for connecting the first lid to one of the following:

(1) another part of the cover means and (2) the body means.

The first hinge means also functions for accommodating the pivoting of the first lid between a closed position occluding the first aperture and an open position spaced away from the first aperture.

The first lid further includes a first engaging means for engaging the body means side wall when the first lid is in the open position. At least one or the other of the first engaging means and body means side wall is resilient. Alternatively, both the first engaging means and body means side wall may be resilient. When the lid is moved to the open position, the first engaging means frictionally engages the body side wall and holds the first lid open.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
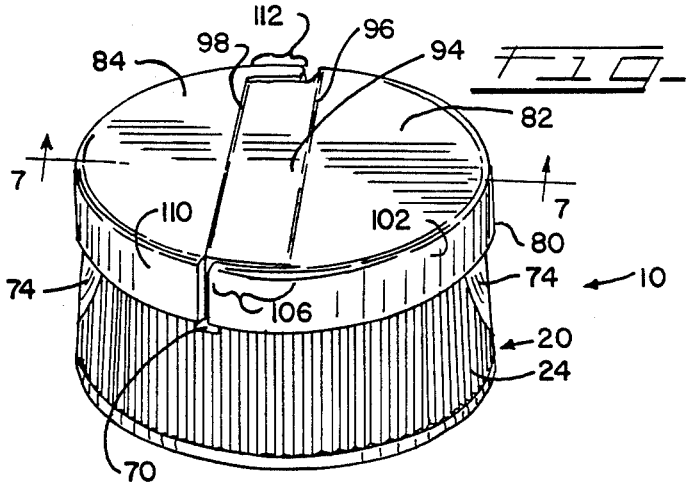
FIG. 1 is a perspective view of the closure of the present invention.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure of the invention is described in a position as it is usually encountered—upright on a container, and terms such as upper, lower, vertical, horizontal, etc. are used with reference to this position. It will be understood, however, that the closure of this invention may be manufactured, stored, transported, and used in an orientation other than the position described.

The closure of the present invention is illustrated in FIGS. 1–7 wherein the closure is represented generally by the reference numeral 10. The closure 10 is adapted to be disposed on a container (not illustrated) which has a conventional mouth or opening defined by a neck or other suitable structure. The closure 10 may be fabricated from a thermoplastic material, or other materials, compatible with the container contents.

Figure 7:
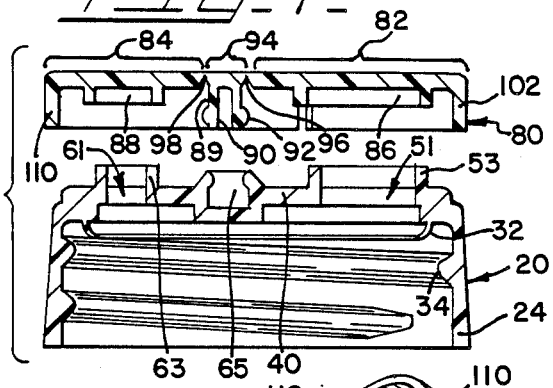
FIG. 7 is an enlarged, exploded, cross-sectional view of the closure taken generally along the planes 7—7 in FIG. 1.

As best illustrated in FIG. 7, the closure 10 includes a body 20 for securement to the container. In the illustrated embodiment, the body 20 includes a peripheral wall in the form of a cylindrical skirt or peripheral side wall 24.

As best illustrated in FIG. 7, the body 20 includes an internal ring 32 which functions as a plug seal and protrudes into the interior of the container neck for engaging the inner peripheral surface of the neck to effect a tight seal.

Further, as best illustrated in FIG. 7, the closure body skirt or peripheral side wall 24 includes, on its interior surface, a conventional thread 34 or other suitable means (e.g., a snap-fit bead (not illustrated)) for engaging suitable cooperating means on the container neck to releasably secure the body 20 to the container.

Figure 6:
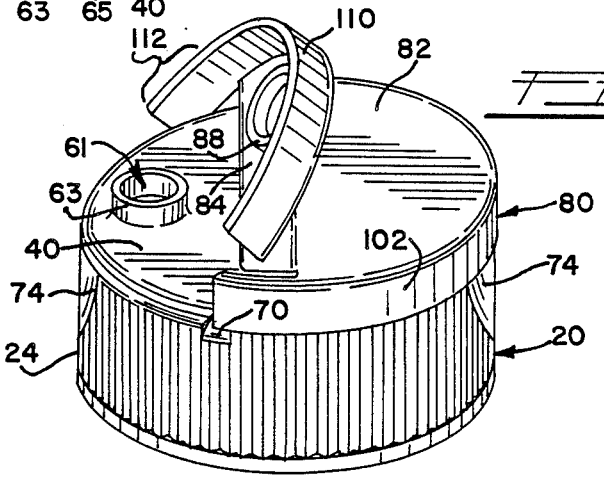
FIG. 6 is a view similar to FIG. 1 but showing a second lid of the closure in the fully opened position.

In the preferred embodiment illustrated, the closure body 20 includes a transverse top wall or deck 40 (FIGS. 6 and 7). As best illustrated in FIG. 6, the peripheral edge of the transverse top wall or deck 40 is preferably rounded to prevent user discomfort.

Figure 3:
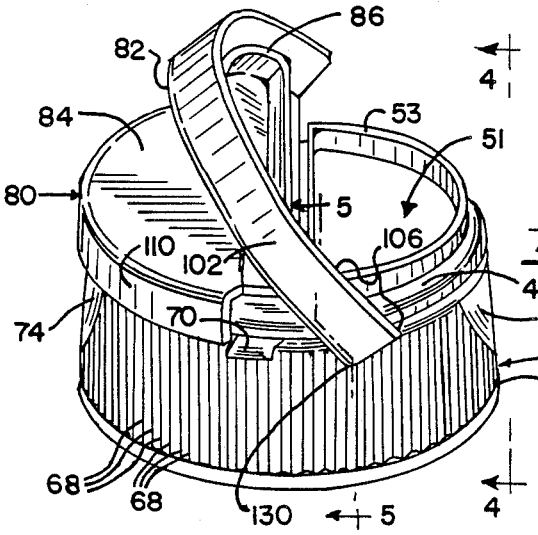
FIG. 3 is a view similar to FIGS. 1 and 2 but showing the first lid in the fully opened orientation.
Figure 4:
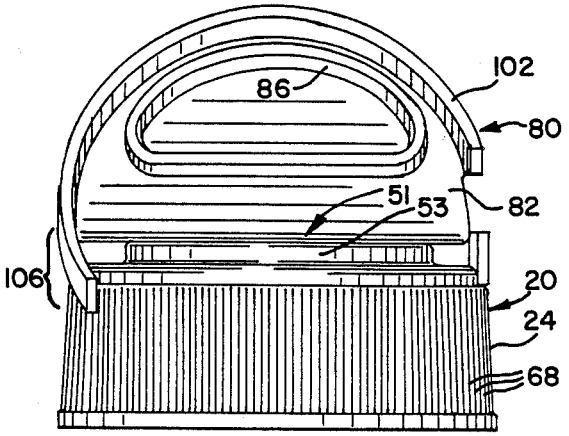
FIG. 4 is a side elevational view taken generally along the plane 4—4 in FIG. 3.

As best illustrated in FIGS. 3 and 4, the transverse top wall 40 of the body 20 defines a first aperture 51 for communicating through the container opening with the container interior. Similarly, as best illustrated in FIGS. 6 and 7, the transverse top wall 40 also defines a second aperture 61 for communicating through the container opening with the container interior.

The first aperture 51 is defined, in part, at the top surface of the transverse top wall 40 by an upwardly projecting flange 53. Similarly, the second aperture 61 is defined, in part, at the top surface of the transverse top wall 40 by an upwardly projecting flange 63.

As best illustrated in FIG. 6, the second aperture 61 is generally circular with the flange 63 being generally cylindrical. On the other, as best illustrated in FIG. 3, the first aperture 51 has the configuration, in plan, of a segment of a circle. In the preferred embodiment illustrated, the area of the first aperture 51 is much larger than the area of the second aperture 61. In a contemplated preferred embodiment, the aperture 51 may be large enough to accommodate the insertion of a spoon. On the other hand, the aperture 61 is relatively small to facilitate dispensing of the contents from the container in a narrow stream or drop-by-drop.

The transverse top wall 40 also includes, as best illustrated in FIG. 7, a resilient, snap-fit type receiving collar 65. The collar may have a generally circular configuration. Preferably, however, the collar 65 is elongate or rectangular with rounded corners, and extends across a major portion of the width of the transverse top wall 40.

The closure body 20 is also provided with a pair of indentations 74 below the transverse top wall 40. The indentations 74 are preferably oriented 180° apart and accommodate a thumb placed adjacent the closure side wall 24 when the closure 10 is to be opened.

The closure body 20 is also provided with unique structures that facilitate the opening of the closure in a manner described in detail hereinafter. To this end, the exterior, peripheral, cylindrical surface of the closure body skirt or side wall 24 is preferably provided with a somewhat rough surface defined by serrations, ribs, or ridges 68. As best illustrated in FIG. 3, a small peripheral portion of the skirt 24 at the upper ends of the ridges 68 defines a camming surface 70 that increases in radial distance from the longitudinal axis of the cylindrical skirt 24 with increasing distance below the body transverse top wall 40. A similar camming surface is provided diametrically opposite on the other side of the closure skirt 24 (not visible in the Figures).

The closure 10 also includes a cover means or cover 80. As best illustrated in FIGS. 1 and 7, the cover 80 defines a first lid 82 to cover the first aperture 51 and defines a second lid 84 to cover the second aperture 61. The underside of the first lid 82 includes a downwardly projecting flange 86 (FIG. 7) for engaging the exterior of the body aperture flange 53 in an interference fit. Preferably, one or both of the flanges 86 and 53 is resilient. The flanges 53 and 86 may be configured in a well-known manner to provide for a snap-fit engagement.

Similarly, the underside of the second lid 84 includes a downwardly projecting flange 88 for engaging the exterior of the flange 63 around the second aperture 61 in the body 20. One or both of the flanges 88 and 63 are preferably resilient and are configured to provide and interference fit or snap-fit.

The cover 80 may be releasably secured to the body 20 by means of the engagement between the first lid 82 and the body 20 and between the second lid 84 and the body 20 as effected through the above-described interference or snap-fits between the cooperating pair of flanges 86 and 53 and between the cooperating pair of flanges 88 and 63, respectively Thus, when the first lid 82 is open (FIG. 3), the cover 80 remains connected to the body 20 through the closed second lid 84. Similarly, when the second lid 84 is open (FIG. 6), the cover 80 remains attached to the body 20 through the closed first lid 82. However, in the preferred embodiment illustrated, the cover 80 is preferably releasably mounted to the body 20 by means of an additional, separate structure which includes the above-described resilient collar 65 on the body 20 and which further includes a projection 89 (FIG. 7) depending downwardly from the underside of the cover 80. The projection 89 includes an internal slot or cavity 90 and a peripheral bead 92. As the projection 89 is inserted into the collar 65, the bead 92 deflects inwardly, and/or the collar 65 deflects outwardly to accommodate the full insertion of the projection 89 into the collar 65 in a snap-fit engagement.

As best illustrated in FIGS. 1 and 7, the illustrated preferred embodiment of the cover 80 may be further characterized as including a bridge 94 between the first lid 82 and second lid 84. The bridge 94 is joined to the first lid 82 with a flexible film hinge 96, and the second lid 84 is joined to the bridge 94 with a flexible film hinge 98. Any suitable hinge means or hinge may be employed for the hinges 96 and 98, and the hinges 96 and 98 need not be of the film-hinge type per se.

As best illustrated in FIG. 1, the first lid 82 is in the form of a transverse closure wall having the shape of a segment of a circle with the pivot axis of the hinge 96 defining the chord of the segment. In addition, the first lid 82 includes a flange 102 that has a partially cylindrical configuration. The flange 102 depends from the arcuate periphery of the transverse closure wall segment shape of the lid 82 and the extends around the arcuate periphery of the transverse closure wall from one end of the chord-like axis of the hinge 96 to the other end of the chord-like axis of the hinge 96. In addition, the first lid 82 includes a first arm 106 which projects away from the pivot axis of the first hinge 96 as an extension of the partially cylindrical flange 102.

The second lid 84 is similar to the first lid 82. The second lid 84 is in the form of a transverse closure wall having the shape of a segment of a circle with the pivot axis of the second hinge 98 defining the chord of the segment.

The second lid 84 also includes a flange 110 that has a partially cylindrical configuration. The flange 110 depends from the arcuate periphery of the transverse closure wall segment shape of the lid 84 and extends around the arcuate periphery of the transverse closure wall from one end of the chord-like axis of the hinge 98 to the other end of the chord-like axis of the hinge 98. In addition, the second lid 84 includes a second arm 112 which projects away from the axis of the second hinge 98 as an extension of the cylindrical flange 110.

It is to be noted that the first lid 82 has only one arm 106, that the second lid 84 has only one arm 112, and that each arm extends alongside an end of the cover bridge 94 opposite the other arm. Each arm 106 and 112 functions as an engaging means for engaging the body 20 when the associated lid is opened as explained in detail hereinafter. Preferably, each arm 106 and 112 is resilient to permit outward deflection. Alternatively, or in addition, the side wall 24 of the closure body 20 may be resilient (at least in the region adjacent the arms 106 and 112) so as to accommodate inward deflection of the side wall 24.

Figure 2:
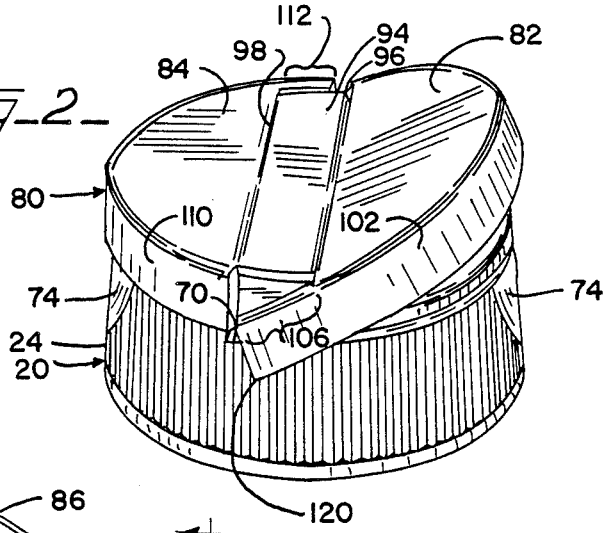
FIG. 2 is a view similar to FIG. 1 but showing a first lid partially open.

FIG. 2 illustrates the first lid 82 as it is being opened. A bottom corner 120 of the first arm 106 is deflected outwardly by the camming surface 70 onto the side wall 24 as the lid 82 is opened. When the lid 82 is pivoted to the fully opened position as illustrated in FIG. 3, a corner 130 of the arm 106 engages the side wall 24 of the closure body 20.

Figure 5:
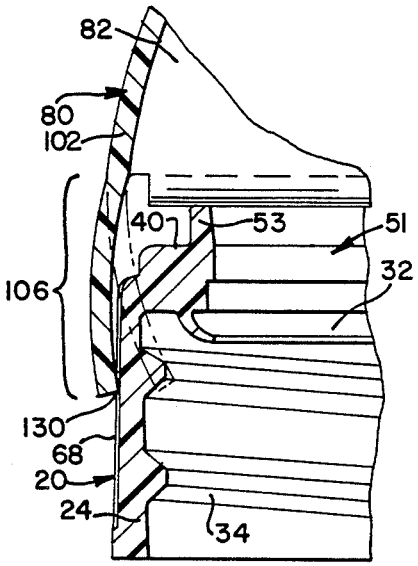
FIG. 5 is a greatly enlarged, fragmentary, cross-sectional view taken generally along the planes 5—5 in FIG. 3.

FIG. 5 illustrates the deflection of the first arm 106 outwardly from its normal orientation when the lid 82 is in the fully opened position. The corner 130 of the first arm 106 frictionally engages the closure body side wall 24. Preferably, the frictional engagement is increased owing to the ridges 68 formed in the closure body side wall 24. The frictional engagement between the first arm 106 and the closure body side wall 24 maintains the lid 82 in the fully opened position. When it is desired to close the first lid 82, the first lid 82 can be pivoted downwardly over the first aperture 51 with sufficient force to overcome the frictional engagement between the first arm 106 and the closure body side wall 24.

The second lid 84 can be moved to the fully opened position illustrated in FIG. 6 and held open by the engagement of its engaging arm 112 with the closure body side wall 24 in a manner identical to that described above for the first lid 82.

In the preferred embodiment illustrated, the first lid 82 and second lid 84 are each connected via hinges 96 and 98, respectively, to the cover bridge 94. However, it is to be realized that the bridge 94 may be eliminated and both lids 82 and 84 may be connected directly together about a single, common hinge.

Further, the lids 82 and 84 need not be provided as part of a separate, releasably mounted cover 80. Rather, each lid 82 and 84 may be directly hingedly mounted to the closure body 20 by a suitable hinge structure integral with the body top wall 40.

Further, although the second lid 84 in the illustrated preferred embodiment is smaller than the first lid 82, it is to be realized that each lid may be of the same size or that the first lid 82 may be smaller than the second lid 84.

Additionally, the closure body 20 may be provided with only one aperture (e.g., either the first aperture 51 or the second aperture 61), and only one lid need then be provided (either as part of a separately mountable cover 80 or as hinged directly to the top wall 40 of the closure body 20).

With the novel closure of the present invention, it is seen that a novel and reliable structure is provided for holding one or more lids in an open position. The structure permits the use of a relatively inexpensive and simple flexible film hinge and permits the closure top to have a generally smooth, flat configuration.

Also, the novel structure for holding the lid or lids open does not interfere with the top transverse wall of the closure body in which the aperture or apertures are defined. This permits the closure designer to maximize the size of the aperture or apertures in the closure body.

Further, the novel structure for holding a lid open in accordance with the present invention permits the lid to be incorporated in a separate, releasable cover. The cover can then be separately fabricated from the closure body. Thus, depending upon the complexities of other features that a closure designer may wish to incorporate in the closure, the separate lid and separate body can each be more easily fabricated with such additional complex features. In addition, fabrication of one or more lids in a cover that is separate from the closure body easily accommodates fabrication of the cover from a material or materials different than those used for the closure body. This also accommodates the use of different colors for such a closure wherein the cover and closure body are separate.

It will be readily observed from the foregoing detailed description of the invention and from the illustrated embodiment thereof that numerous other variations and modifications may be effected without departing from the true spirit and scope of the novel concepts or principles of this invention.

What is claimed is:

1. A closure for use on a container defining an opening communicating with the container interior, said closure comprising:

a body for being mounted to said container over said container opening and defining at least a first aperture for communicating through said container opening with the container interior, said body having a peripheral side wall outwardly of said first aperture, said body including a transverse top wall defining at least said first aperture;

a cover mounted to said body over said body top wall and defining at least a first lid;

at least a first hinge means for connecting said first lid directly to another part of said cover for accommodating the pivoting of said first lid between a closed position occluding said first aperture and an open position spaced away from said first aperture;

said first lid including a first arm at one end of said first hinge means projecting away from the rest of said first lid beyond said first hinge means;

at least one of said first arm and said side wall being resilient; and said first arm being configured to engage said body side wall when said first lid is in said open position whereby said first lid is held in said open position by frictional engagement between said first arm and said side wall.

2. The closure in accordance with claim 1 in which said another part of said cover includes a stationary bridge mounted to said body top wall.

3. The closure in accordance with claim 2 in which said body defines a second aperture for communicating through said container opening with the container interior;

in which cover defines a second lid for occluding said second aperture; and in which said closure includes a second hinge means for connecting said second lid to said stationary bridge for pivoting between a closed position occluding said second aperture and an open position spaced away from said second aperture.

4. The closure in accordance with claim 3 in which said first and second hinge means define first and second pivot axes, respectively, and in which said first and second pivot axes are parallel.

5. A closure for use on a container defining an opening communicating with the container interior, said closure comprising:

a body for being mounted to said container over said container opening and defining at least a first aperture for communicating through said container opening with the container interior, said body having a peripheral side wall outwardly of said first aperture;

a cover on said body and defining at least a first lid;

at least a first hinge means for accommodating the pivoting of said first lid between a closed position occluding said first aperture and an open position spaced away from said first aperture and for connecting said first lid directly to another part of said cover;

said first lid including a first arm at one end of said first hinge means projecting away from the rest of said first lid beyond said first hinge means;

at least one of said first arm and said side wall being resilient; and said first arm being configured to engage said body said wall when said first lid is in said open position whereby said first lid is held in said open position by frictional engagement between said first arm and said side wall;

said body side wall being generally cylindrical;

said first hinge means defining a first pivot axis;

said first lid including (1) a transverse closure wall for occluding at least said first aperture and having the shape of a segment of a circle with said first pivot axis defining the chord of said segment, and (2) a flange that (a) has a partially cylindrical configuration, (b) depends from the arcuate periphery of said transverse closure wall, and (c) extends around the arcuate periphery of said transverse closure wall from one end of said chord to the other end of said chord; and said first arm projecting away from said first pivot axis as an extension of said partially cylindrical flange.

6. The closure in accordance with claim 5 in which said first arm defines at least a partially cylindrical, inner surface lying in a cylindrical locus;

in which the diameter of said cylindrical locus is less than the diameter of the exterior surface of said cylindrical side wall of said body; and in which a portion of said body cylindrical side wall defines a camming surface that is located below said first arm and that increases in radial distance from the longitudinal axis of the cylindrical side wall with increasing distance below said cover whereby, as said first lid is opened, said first arm inner surface engages said camming surface and said first arm is deflected outwardly by said camming surface onto the exterior surface of said side wall.

7. A closure for use on a container defining an opening communicating with the container interior, said closure comprising:

a body for being mounted to said container over said container opening and defining at least a first aperture for communicating through said container opening with the container interior, said body having a peripheral side wall outwardly of said first aperture;

a cover on said body and defining at least a first lid;

at least a first hinge means for accommodating the pivoting of said first lid between a closed position occluding said first aperture and an open position spaced away from said first aperture and for connecting said first lid directly to another part of said cover;

said first lid including a first arm at one end of said first hinge means projecting away from the rest of said first lid beyond said first hinge means;

at least one of said first arm and said side wall being resilient; and said first arm being configured to engage said body side wall when said first lid is in said open position whereby said first lid is held in said open position by frictional engagement between said first arm and said side wall;

said body defining a second aperture for communicating through said container opening with the container interior;

said cover defining a second lid; and said first and second lids being connected together by said first hinge means to accommodate (1) pivoting of said first lid between a closed position occluding said first aperture and an open position spaced away from said first aperture and (2) pivoting of said second lid between a closed position occluding said second aperture and an open position spaced away from said second aperture.

8. The closure in accordance with claim 7 in which said first lid and said body together define a first cooperating resilient engaging means for releasably holding said first lid closed in a first interference fit; and in which said second lid and said body together define a second cooperating resilient engaging means for releasably holding said second lid closed in a second interference fit.

9. A closure for use on a container defining an opening communicating with the container interior, said closure comprising:

a body for being mounted to said container over said container opening and defining at least a first aperture for communicating through said container opening with the container interior, said body having a peripheral side wall outwardly of said first aperture;

a cover on said body and defining at least a first lid;

at least a first hinge means for accommodating the pivoting of said first lid between a closed position occluding said first aperture and an open position spaced away from said first aperture and for connecting said first lid directly to another part of said cover;

said first lid including a first arm at one end of said first hinge means projecting away from the rest of said first lid beyond said first hinge means;

at least one of said first arm and said side wall being resilient; and said first arm being configured to engage said body side wall when said first lid is in said open position whereby said first lid is held in said open position by frictional engagement between said first arm and said side wall;

said body including a transverse top wall defining said first aperture and defining a second aperture communicating through said container opening with the container interior;

said cover being mounted to said body over said body top wall;

said cover including a stationary bridge extending over said body and includes a second lid for occluding said second aperture;

said first hinge means connecting said first lid with said stationary bridge about a first pivot axis; and said closure including a second hinge means for connecting said second lid to said stationary bridge for pivoting about a second pivot axis between a closed position occluding said second aperture and an open position spaced away from said second aperture.

10. The closure in accordance with claim 9 in which said first lid and said body together define a first cooperating resilient engaging means for releasably holding said first lid closed in a first interference fit; and in which said second lid and said body together define a second cooperating resilient engaging means for releasably holding said second lid closed in a second interference fit.

11. A closure for use on a container defining an opening communicating with the container interior, said closure comprising:

a body for being mounted to said container over said container opening, said body including a transverse top wall defining at least a first aperture for communicating through said container opening with the container interior, said body having a peripheral side wall outwardly of said first aperture;

a cover on said body and including at least a first lid, said cover further including a stationary bridge mounted to said body transverse top wall;

at least a first hinge means for connecting said first lid to said stationary bridge for pivoting between a closed position occluding said first aperture and an open position spaced away from said first aperture;

said first lid including a first arm at one end of said first hinge means projecting away from the rest of said first lid beyond said first hinge means adjacent said stationary bridge;

at least one of said first arm and said side wall being resilient; and said first arm being configured to engage said body side wall when said first lid is in said open position whereby said first lid is held in said open position by frictional engagement between said first arm and said side wall.

12. A closure for use on a container defining an opening communicating with the container interior, said closure comprising:

body means for being mounted to said container over said container opening and for defining at least a first aperture for communicating through said container opening with the container interior, said body means having a peripheral side wall outwardly of said first aperture;

cover means on said body means for defining at least a first lid to cover said first aperture;

at least a first hinge means for connecting said first lid to another part of said cover means and for accommodating the pivoting of said first lid about an axis over said container opening between a closed position occluding said first aperture and an open position spaced away from said first aperture; and said first lid including a first engaging means for engaging said body means side wall when said first lid is in said open position, at least one of said first engaging means and said body means side wall being resilient whereby said first lid is held in said open position by frictional engagement between said first engaging means and said body means side wall.

13. The closure in accordance with claim 12 in which said first engaging means includes a resilient first arm at one end of said first hinge means, said first arm projecting away from the rest of said first lid beyond said first hinge means; and in which said body means peripheral side wall defines exterior ridges for being engaged by said first arm.

14. A closure for use on a container defining an opening communicating with the container interior, said closure comprising:

body means for being mounted to said container over said container opening and for defining at least a first aperture for communicating through said container opening with the container interior, said body means having a peripheral side wall outwardly of said first aperture;

cover means on said body means for defining a stationary bridge and at least a first lid to cover said first aperture;

at least a first hinge means for connecting said first lid to said bridge for accommodating the pivoting of said first lid between a closed position occluding said first aperture and an open position spaced away from said first aperture; and said first lid including a first engaging means for engaging said body means side wall when said first lid is in said open position, at least one of said first engaging means and said body means side wall being resilient whereby said first lid is held in said open position by frictional engagement between said first engaging means and said body means side wall.

15. A closure for use on a container defining an opening communicating with the container interior, said closure comprising:

body means for being mounted to said container over said container opening and for defining at least a first aperture for communicating through said container opening with the container interior, said body means having a peripheral side wall outwardly of said first aperture;

cover means on said body means for defining at least a first lid to cover said first aperture;

at least a first hinge means for connecting said first lid to another part of said cover means and for accommodating the pivoting of said first lid between a closed position occluding said first aperture and an open position spaced away from said first aperture;

said first lid including a first engaging means for engaging said body means side wall when said first lid is in said open position, at least one of said first engaging means and said body means side wall being resilient whereby said first lid is held in said open position by frictional engagement between said first engaging means and said body means side wall;

said body means defining a second aperture for communicating through said container opening with the container interior;

said closure including a second hinge means for accommodating the pivoting of said second lid between a closed position occluding said second aperture and an open position spaced away from said second aperture and for connecting said second lid to another part of said cover means; and said second engaging means including a resilient second arm at one end of said second hinge means, said second arm projecting away from the rest of said second lid beyond said second hinge means.

16. The closure in accordance with claim 15 in which said cover means includes a stationary bridge;

in which said first hinge means connects said first lid to said bridge; and in which said second hinge means connects said second lid to said bridge.

17. A closure for use on a container defining an opening communicating with the container interior, said closure comprising:

body means for being mounted to said container over said container opening and for defining at least a first aperture for communicating through said container opening with the container interior, said body means having a peripheral side wall outwardly of said first aperture, said body means defining a resilient collar;

cover means on said body means for defining at least a first lid to cover said first aperture, said cover means including a projection for being releasably held by said collar in snap-fit engagement to hold said cover means on said body means;

at least a first hinge means for connecting said first lid to another part of said cover means and for accommodating the pivoting of said first lid between a closed position occluding said first aperture and an open position spaced away from said first aperture; and said first lid including a first engaging means for engaging said body means side wall when said first lid is in said open position, at least one of said first engaging means and said body means side wall being resilient whereby said first lid is held in said open position by frictional engagement between said first engaging means and said body means side wall.

18. A closure for use on a container defining an opening communicating with the container interior, said closure comprising:

a body for being mounted to said container over said container opening and defining at least a first aperture for communicating through said container opening with the container interior, said body having a peripheral side wall outwardly of said first aperture;

a cover on said body and defining at least a first lid;

at least a first hinge means for accommodating the pivoting of said first lid between a closed position occluding said first aperture and an open position spaced away from said first aperture and for connecting said first lid directly to said body;

said first lid including a first arm at one end of said first hinge means projecting away from the rest of said first lid beyond said first hinge means;

at least one of said first arm and said side wall being resilient;

said first arm being configured to engage said body side wall when said first lid is in said open position whereby said first lid is held in said open position by frictional engagement between said first arm and said side wall;

said body side wall being generally cylindrical;

said first hinge means defining a first pivot axis;

said first lid including (1) a transverse closure wall for occluding at least said first aperture and having the shape of a segment of a circle with said first pivot axis defining the chord of said segment, and (2) a flange that (a) has a partially cylindrical configuration, (b) depends from the arcuate periphery of said transverse closure wall, and (c) extends around the arcuate periphery of said transverse closure wall from one end of said chord to the other end of said chord; and said first arm projecting away from said first pivot axis as an extension of said partially cylindrical flange.

19. The closure in accordance with claim 18 in which said first arm defines at least a partially cylindrical, inner surface lying in a cylindrical locus;

in which the diameter of said cylindrical locus is less than the diameter of the exterior surface of said cylindrical side wall of said body; and in which a portion of said body cylindrical side wall defines a camming surface that is located below said first arm and that increases in radial distance from the longitudinal axis of the cylindrical side wall with increasing distance below said cover whereby, as said first lid is opened, said first arm inner surface engages said camming surface and said first arm is deflected outwardly by said camming surface onto the exterior surface of said side wall.

20. A closure for use on a container defining an opening communicating with the container interior, said closure comprising:

a body for being mounted to said container over said container opening and defining at least a first aperture for communicating through said container opening with the container interior, said body having a peripheral side wall outwardly of said first aperture;

a cover on said body and defining at least a first lid;

at least a first hinge means for accommodating the pivoting of said first lid between a closed position occluding said first aperture and an open position spaced away from said first aperture and for connecting said first lid directly to said body;

said first lid including a first arm at one end of said first hinge means projecting away form the rest of said first lid beyond said first hinge means;

at least one of said first arm and said side wall being resilient;

said first arm being configured to engage said body side wall when said first lid is in said open position whereby said first lid is held in said open position by frictional engagement between said first arm and said side wall;

said body defining a second aperture for communicating through said container opening with the container interior;

said cover defining a second lid; and said first hinge means connecting said second lid directly to said body along with said first lid about a common hinge axis to accommodate (1) pivoting of said first lid between a closed position occluding said first aperture and an open position spaced away from said first aperture and (2) pivoting of said second lid between a closed position occluding said second aperture and an open position spaced away from said second aperture.

21. The closure in accordance with claim 20 in which said first lid and said body together define a first cooperating resilient engaging means for releasably holding said first lid closed in a first interference fit; and in which said second lid and said body together define a second cooperating resilient engaging means for releasably holding said second lid closed in a second interference fit.

22. A closure for use on a container defining an opening communicating with the container interior, said closure comprising:

body means for being mounted to said container over said container opening and for defining at least a first aperture for communicating through said container opening with the container interior, said body means having a peripheral side wall outwardly of said first aperture;

cover means on said body means for defining at least a first lid to cover said first aperture;

at least a first hinge means for accommodating the pivoting of said first lid between a closed position occluding said first aperture and an open position spaced away from said first aperture and for connecting said first lid to said body means;

said first lid including a first engaging means for engaging said body means side wall when said first lid is in said open position, at least one of said first engaging means and said body means side wall being resilient whereby said first lid is held in said open position by frictional engagement between said first engaging means and said body means side wall;

said body means defining a second aperture for communicating through said container opening with the container interior;

said closure including a second hinge means for accommodating the pivoting of said second lid between a closed position occluding said second aperture and an open position spaced away from said second aperture and for connecting said second lid to said body means; and said second engaging means including a resilient second arm at one end of said second hinge means, said second arm projecting away from the rest of said second lid beyond said second hinge means.

23. A closure for use on a container defining an opening communicating with the container interior, said closure comprising:

body means for being mounted to said container over said container opening and for defining at least a first aperture for communicating through said container opening with the container interior, said body means having a peripheral side wall outwardly of said first aperture;

cover means on said body means for defining at least a first lid to cover said first aperture;

at least a first hinge means for connecting said first lid to said body means for accommodating the pivoting of said first lid about an axis over said container opening between a closed position occluding said first aperture and an open position spaced away from said first aperture; and said first lid including a first engaging means for engaging said body means side wall when said first lid is in said open position, at least one of said first engaging means and said body means side wall being resilient whereby said first lid is held in said open position by frictional engagement between said first engaging means and said body means side wall.

24. The closure in accordance with claim 23 in which said first engaging means includes a resilient first arm at one end of said first hinge means, said first arm projecting away from the rest of said first lid beyond said first hinge means; and in which said body means peripheral side wall defines exterior ridges for being engaged by said first arm.

* * * * *